US010322776B2

(12) United States Patent
Ventura et al.

(10) Patent No.: US 10,322,776 B2
(45) Date of Patent: Jun. 18, 2019

(54) LEASH OR CORD LIFT SYSTEM

(71) Applicants: Trenton Ventura, Myrtle Beach, SC (US); Meghan Anne Douty, Myrtle Beach, SC (US)

(72) Inventors: Trenton Ventura, Myrtle Beach, SC (US); Meghan Anne Douty, Myrtle Beach, SC (US)

( * ) Notice: Subject to any disclaimer, the term of this patent is extended or adjusted under 35 U.S.C. 154(b) by 0 days.

(21) Appl. No.: 15/809,517

(22) Filed: Nov. 10, 2017

(65) Prior Publication Data

US 2019/0144085 A1 May 16, 2019

(51) Int. Cl.
*B63B 35/79* (2006.01)

(52) U.S. Cl.
CPC .... *B63B 35/7933* (2013.01); *B63B 2035/794* (2013.01)

(58) Field of Classification Search
CPC ..... B63B 2035/794
See application file for complete search history.

(56) References Cited

U.S. PATENT DOCUMENTS 4,917,049 A * 4/1990 Peterson ..... A01K 27/005 119/864
5,194,026 A * 3/1993 Corwin ..... B63B 35/7933 280/637
6,942,532 B2 * 9/2005 Snyder ..... B63B 35/7933 114/382
7,481,689 B2 * 1/2009 Wiginton ..... B63B 35/7933 441/75
8,474,668 B2 * 7/2013 Toman ..... A45F 5/00 224/219
2013/0216085 A1 * 8/2013 Honeycutt ..... H04R 1/028 381/374
2014/0033394 A1 * 2/2014 Stauffer ..... H01F 7/0263 2/69

* cited by examiner

*Primary Examiner* — Andrew Polay
(74) *Attorney, Agent, or Firm* — Kristin M. Crall, Esq.; Kilpatrick Townsend & Stockton LLP

(57) ABSTRACT

Embodiments of the present disclosure relate generally to an improved surfboard or paddleboard leash or other cord system that raises the leash line away from the board or surface in order to prevent it from interfering with the user's freedom of movement.

18 Claims, 11 Drawing Sheets

LEASH OR CORD LIFT SYSTEM

FIELD OF THE DISCLOSURE

Embodiments of the present disclosure relate generally to an improved surfboard or paddleboard leash or other cord system that raises the leash line away from the board or surface to prevent it from interfering with the user's freedom of movement.

BACKGROUND

Surfing is an age old hobby that continues to grow in popularity. A surfboard is usually attached to the user's leg via a leash. One end of the leash is secured around a portion of the user's leg, such as the ankle or calf, and another end of the leash is secured to the board. The leash prevents the surfboard from being separated from the user during a fall. Without the use of a leash, the surfboard could be pulled out to sea due to wave action and/or the tide. In other instances, the surfboard could be pushed closer to shore, requiring the user to swim a greater distance than would otherwise be necessary in order to retrieve the board. Use of a leash can also provide an important safety feature. In a deep water fall, the surfer may become disoriented. Due to the flotation nature of the surfboard, being connected to the leash will always indicate to the surfer which direction is "up"—the direction of the water surface.

Stand-up paddle boarding has also enjoyed enhanced popularity. Similar to use of a surfboard leash, a paddle boarder secures one end of a leash to his/her leg, such as the ankle or calf, and another end of the leash to the paddleboard. Being attached to the board provides similar advantages to those described above, particularly when paddle boarding in strong currents always. It is envisioned that other board sports or water sports may also enjoy benefits from having the board attached to the user. This disclosure is envisioned possible for any other type of appropriate sport.

However, the use of a leash can sometimes create hazardous conditions as well. It is possible that the leash may become tangled around the user's limbs or equipment in use. For example, the leash may tangle around the ankle, the calf, the arms, and/or the neck; in other instances, the leash may tangle around equipment, such as a paddle, the board itself, or video or other equipment. Such entanglement can cause a fall to be more dangerous. For example, if the boarder's ankles are caught in the leash, it may be more difficult to control a wipe out fall in a particular way or to fall off of a particular side of the board. Instead, the user's options may be more limited, which can create the potential for injuries. Additionally, an entangled board leash may limit the user's ability to traverse back and forth on the board, which can limit mobility and style.

One previously attempted solution has been to use a pull tab system that secures the leash at the surfer's waist and allows the surfer to release the pull tab prior to a fall. This system uses a VELCRO® member (or other type of hook and loop material) located at the waist of the surfer to which the leash is attached. The VELCRO® design utilizes a single strip of fabric with either side of the VELCRO® attached to the strip of fabric with a bare patch between the two and an additional tab of fabric at the end to act as a "pull tab." This requires the leash to be placed between the two patches of VELCRO®, allowing it to freely slide while hanging. This design also requires the user to actively pull the tab during a fall in order to release the leash from the VELCRO® system. If the user is unable to pull the tab, then when the leash is pulled taught in a fall, the user's ankle or calf (the point of leash attachment) will be pulled up to the waist (the point of the VELCRO® device), which could potentially harm the wearer. The intent behind this system is to provide a rapid attachment but to also allow a breakaway when the surfer pulls the tab, allowing the leash to be freed. However, the present inventors have found that this system is not optimal. It requires the surfer to consciously pull the tab in order to release the leash. It is not designed to automatically detach the leash. Accordingly, an improved leash lift system is provided herein.

BRIEF SUMMARY

Embodiments of the invention described herein thus provide systems and methods for an improved surfboard or paddleboard leash system that raises the leash line away from the board to prevent it from interfering with the user's freedom of movement on the board. Although described primarily for use with water sports boards, it should be understood that this disclosure may also be used to manage other types of dangling cords. Non-limiting examples of cords or leashes that may be managed using the leash lift system described include but are not limited to extension cords, vacuum cords, animal leashes, or any other time a user may need to manage a trailing or potentially entangling cord or leash.

The leash lift system generally includes a board leash comprising a leash-interfacing magnet; and a user garment comprising a user-interfacing magnet. In use, the user secures the leash-interfacing magnet to the user-interfacing magnet in order to raise the leash above the board.

DETAILED DESCRIPTION

Generally, a surfboard or paddleboard 10 (collectively referred to herein as a "board") is provided with a leash 12.

Figure 1:
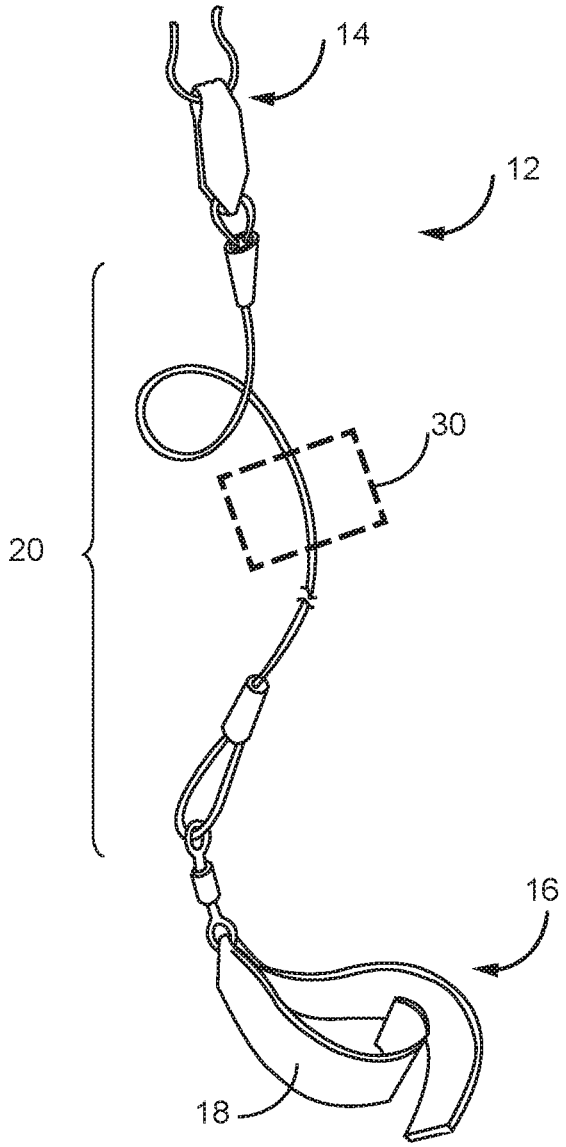
FIG. 1 shows a side perspective view of a surfboard or paddleboard leash.

As shown by FIG. 1, the leash is often provided as a rubber-like, flexible, elongated cord that has a first end 14 and a second end 16. The first end 14 of the leash 12 is configured to be secured to the board 10. (The board will often have a deck plug or hook/loop into which the first end 14 is inserted and the remainder of the leash is pulled through a loop to secure the leash to board. This is a standard leash securement and need not be described further.) The second end 16 of the leash 12 is configured to be secured around a user's ankle or calf. (This securement is often via a hook and loop attachment band 18.) The leash body 20, which is the portion of the leash in between the first end 14 and the second end 16, generally remains loose and rests on the board or drags in the water in use. The leash body 20 is generally long enough to allow a user to have enough clearance space away from the board in the event of a fall. Often, a user will choose a leash that is about the length of the board. For example, a user of a 7 foot board is likely to choose a 7 foot leash. Leashes can range from about 4 feet for a child's board to about 12 feet for a long stand-up paddleboard. Smaller or longer leashes are possible, depending upon the experience and ability level of the user and the type of waves to be ridden.

Leashes may also vary in thickness. A thinner leash has less strength, but will also generate less drag in the water. By contrast, a thicker leash may be stronger, but in turn, may create more drag in the water. Board leashes are generally sold separately from boards for this reason. Leash dimension selection is a matter of preference, and all of the options described herein are intended for use on any type (length, width, material) of board leash. Because some leashes can get rather long, the leash body 20 can become unwieldy during the wave ride or the stand-up paddleboarding (SUP) experience.

Although described primarily for use with water sports boards, it should be understood that this disclosure may also be used to manage other types of dangling cords. For example, a vacuum cleaner cord can generate frustration and management difficulty. Similarly, extension cords for electric devices, such as leaf blowers or electric lawnmowers, can create similar management difficulty. It is also envisioned that this disclosure may be used in connection with any other extended cord or leash management.

Figure 8:
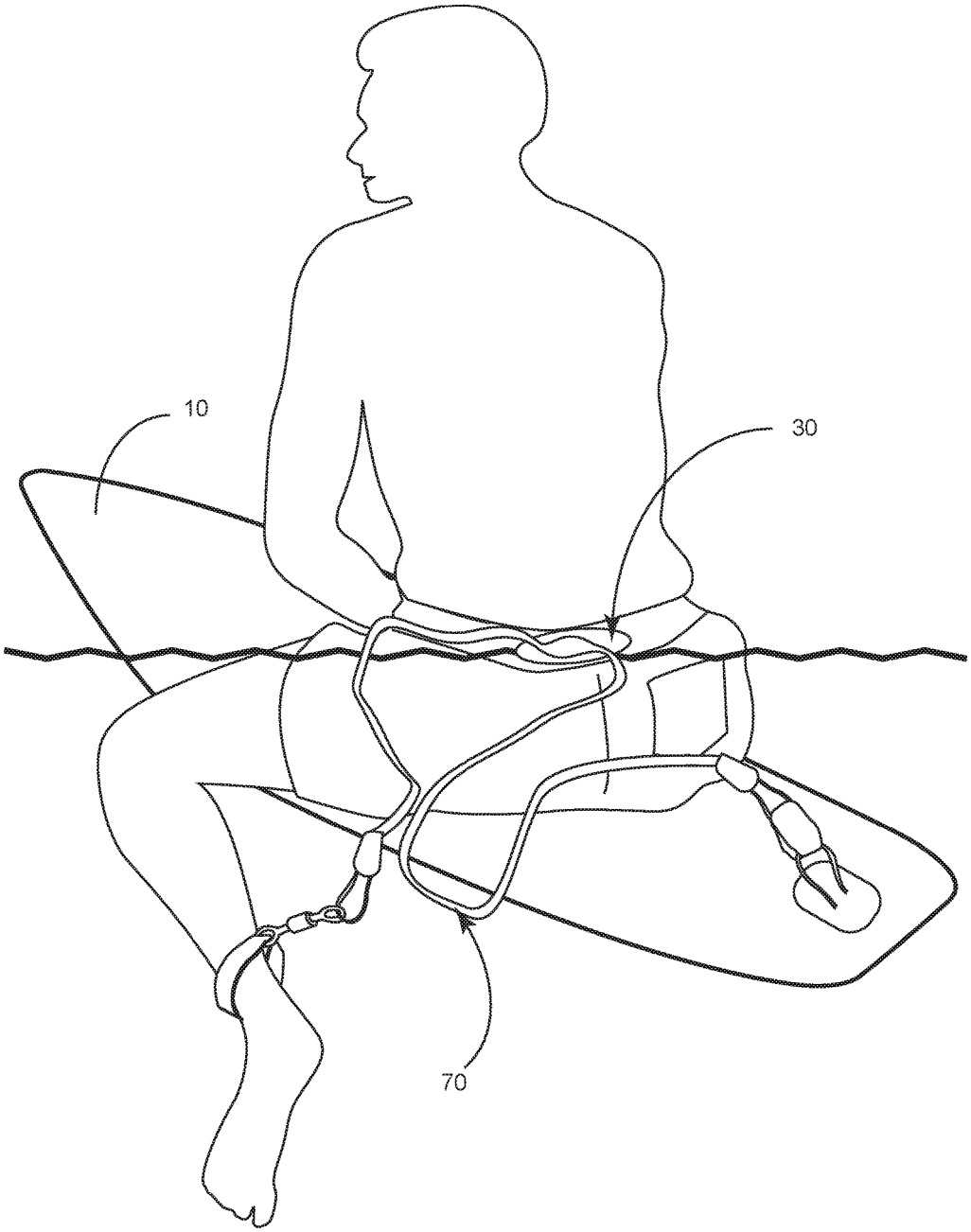
FIG. 8 illustrates a user of the leash system described herein in position on a surfboard.
Figure 9:
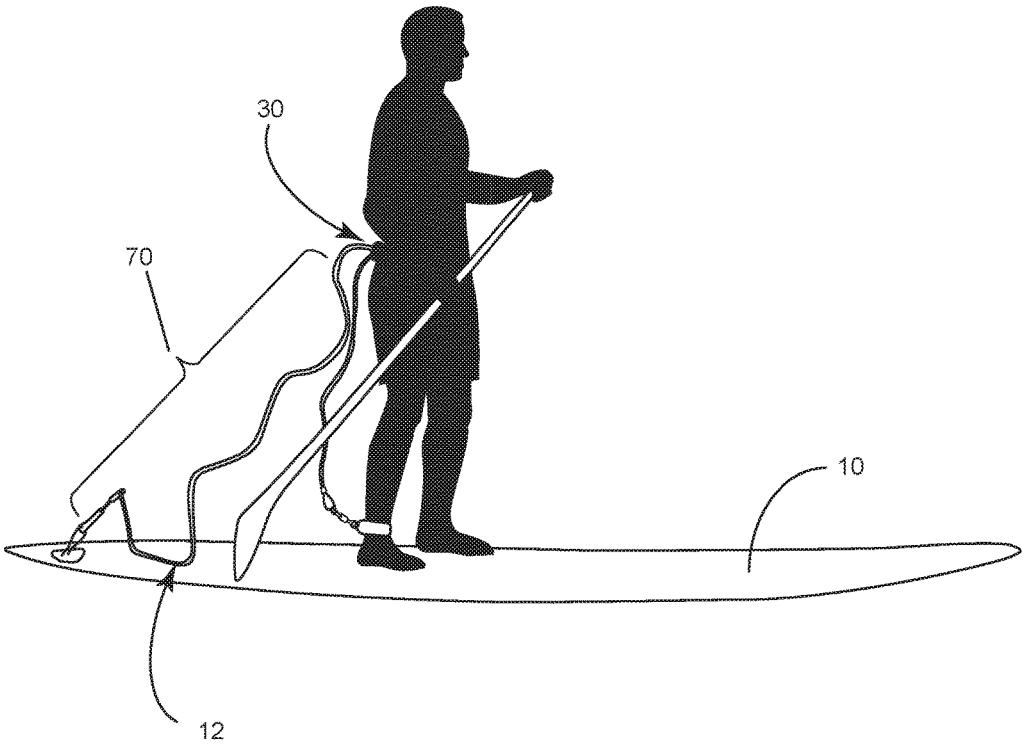
FIG. 9 illustrates a user of the leash system described herein in position on a stand-up paddleboard.

Accordingly, the leash lift system 30 described herein is provided. The leash lift system 30 includes one or more leash-interfacing magnets 32 and a user-interfacing magnet 34. In use, the leash-interfacing magnet 32 cooperates with the user-interfacing magnet 34 in order to maintain at least a portion of the leash body 20 raised up and away from the board. Examples are illustrated by FIGS. 8 and 9. The strength, size, number of magnets and placement of the magnets used is determined by leash or cord size, length, material, and width.

In some examples, for a shorter leash, a single leash-interfacing magnet 32 may be sufficient. However, in other examples, a longer leash may benefit from multiple leash-interfacing magnets. For example, a leash (or cord) may be so long that providing more than one magnet in the leash can allow it to hang like a lasso from the user's waist. Similar to the motion of coiling an extension cord, the one or more leash-interfacing magnets on a long leash could be used to coil the leash, aligning each of the multiple magnets at the top of the coil to the user's waist.

Figure 2A:
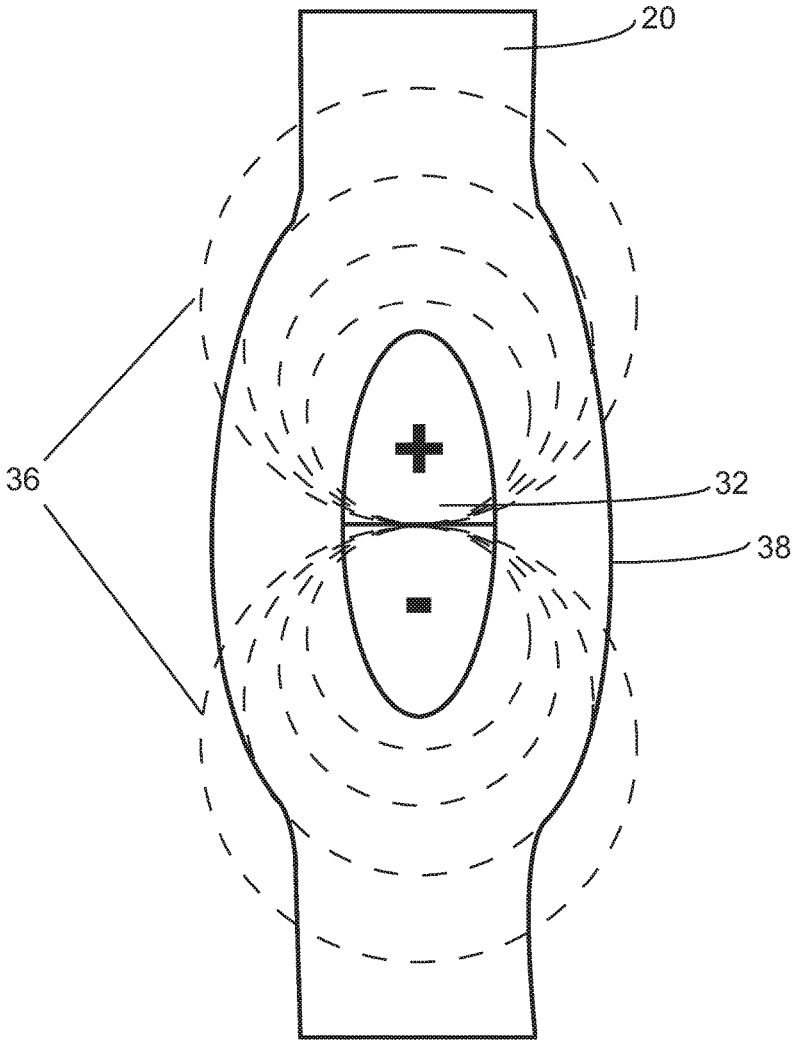
FIG. 2A shows a top plan view of one embodiment of a leash-interfacing magnet.
Figure 2B:
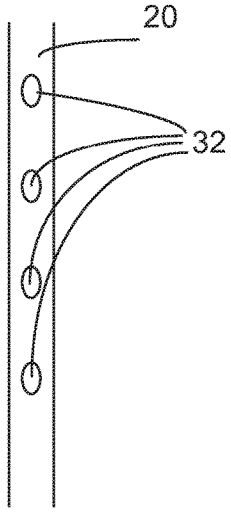
FIG. 2B shows a top plan view of an alternate embodiment of a leash-interfacing magnet.

Referring now to FIGS. 2A and 2B, in one embodiment, the leash-interfacing magnet 32 may be stitched into the leash body 20. In this example, the magnet is inserted inside the leash during manufacture. This may create a magnetic field 36 that radiates from the leash body 20. It is possible for the stitching location to be defined as a bulb 38 or otherwise as a portion with slightly protruding sides or a slightly thicker portion of the leash body 20, as is shown by FIG. 2A. In this example, the user can easily feel along the leash body 20 in order to locate the bulb 38. In other examples, it is possible to provide a plurality of leash-interfacing magnets 32 positioned within the leash body 20, as shown by FIG. 2B. The user may be able to feel one or more of the individual magnets 32 along the leash body 20 by pinching the leash body 20 in order to ease user location of the magnet(s) 32. In another example, it is possible to provide a different leash color and/or leash texture where the one or more leash-interfacing magnets 32 are positioned. This may ease user location of the leash lift system by providing an external visual surface along the leash body 20 and/or providing ease with a tactile touch/feel to location the position of the external magnets. A single version or one or more combinations of any of the disclosed leash-interfacing magnet 32 location systems may be used.

Figure 3A:
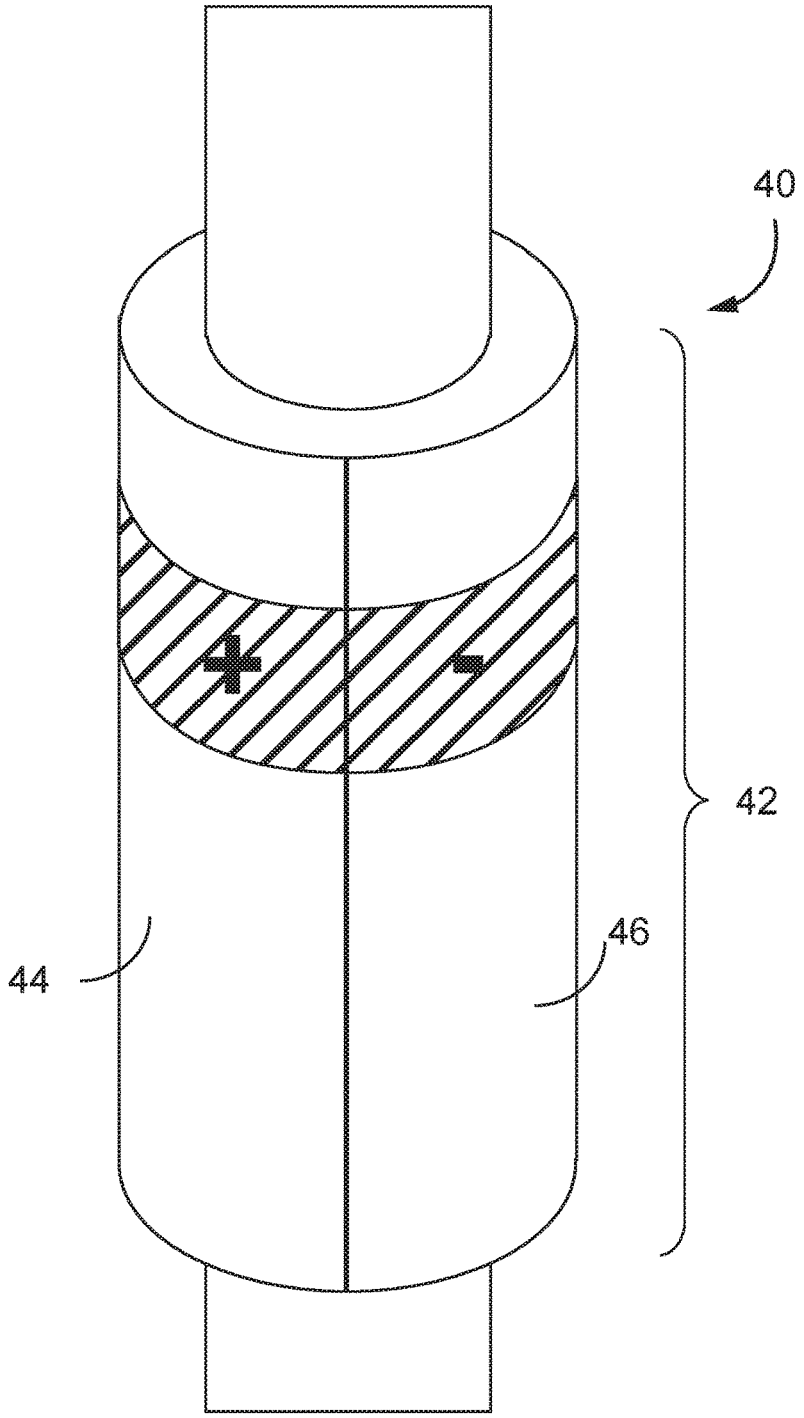
FIG. 3A shows a side perspective view of one embodiment of an externally positioned leash-interfacing magnet.
Figure 3B:
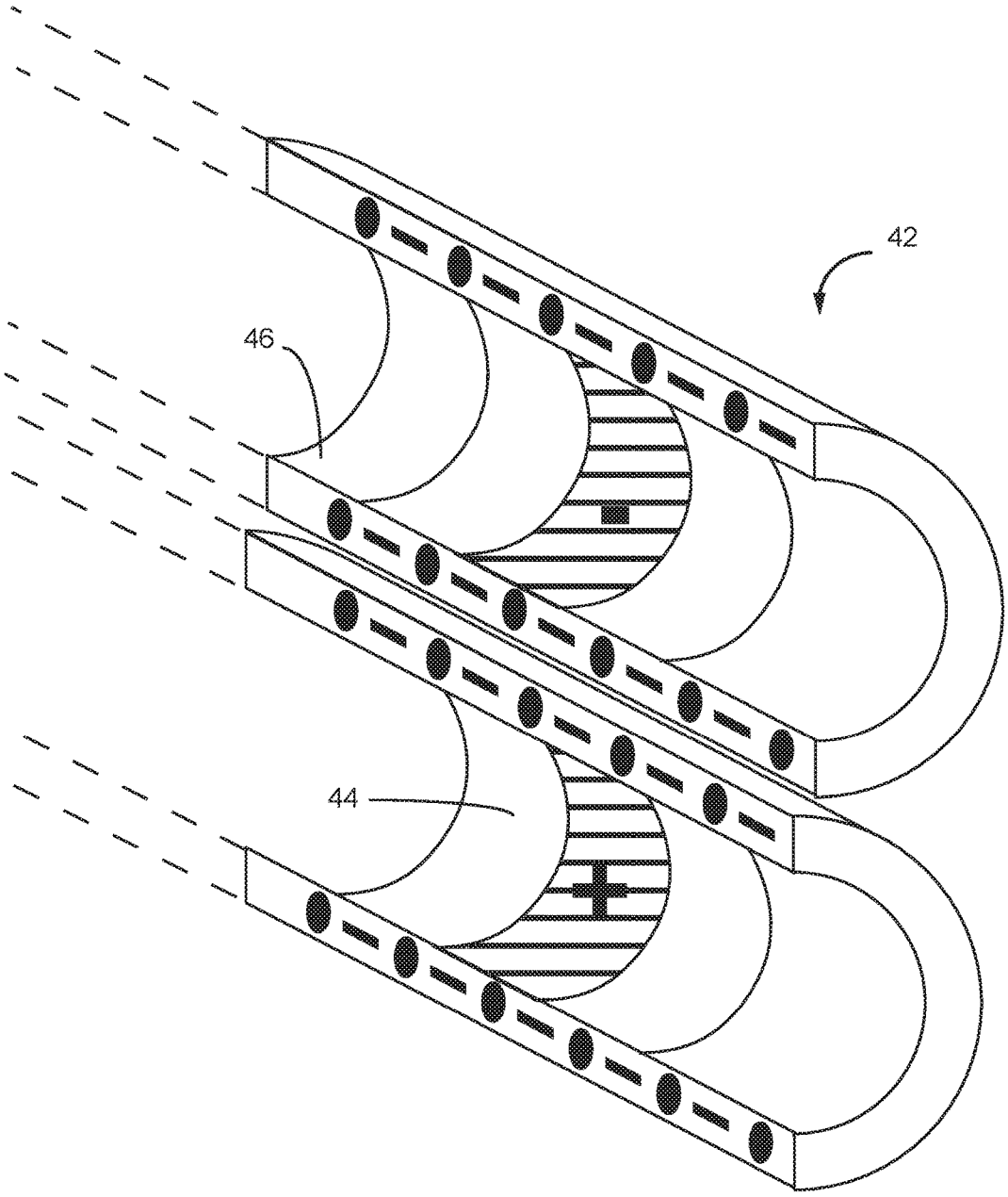
FIG. 3B shows a side perspective view of the externally positioned leash-interfacing magnet of FIG. 3A in an opened position.

In an alternate embodiment, the leash-interfacing magnet 32 may be an externally-positioned system 40, as illustrated by FIGS. 3A and 3B. In this example, the magnet may be attached to the leash using an aftermarket device. This embodiment may be manufactured and sold as a separate leash lift system, because it is not required to be integrated into the original leash body. Instead, a user may use the externally-positioned system 40 to retrofit any currently available leash. In one example, the externally-positioned system 40 may be a clamshell-like member 42. The clamshell member 42 may have first and second portions 44, 46. In a specific embodiment, it is possible for each of the portions to have a certain polarity. In the example shown, the first portion 44 is associated with a positive polarity, and the second portion 46 is associated with a negative polarity. The first and second portions 44, 46 may be designed such that they are hingedly connected along one edge. The first and second portions 44, 46 may be designed such that they snap to one another. The first and second portions 44, 46 may be designed such that they are magnetically connected to one another. Clamshell examples are illustrated by FIG. 3B. In another example, a silicone mold with a magnet formed therein may be used to form the leash-interfacing magnet. Peel and stick technology may be used to secure the magnet to the leash. Any combination of these attachment mechanisms or any other appropriate attachment mechanisms may be used and are considered within the scope of this disclosure. It is also possible to use an internal and an external attachment for the leash-interfacing magnet 32 in combination, if desired.

Figure 4:
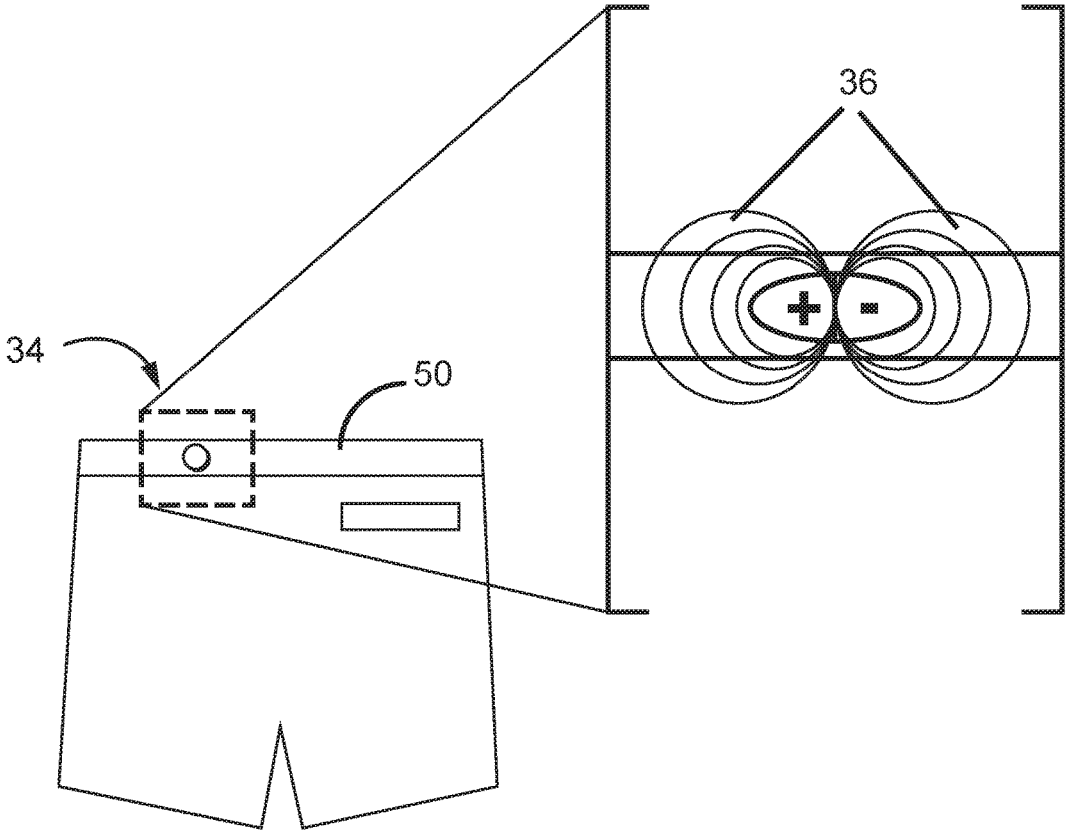
FIG. 4 shows a front plan view of a user garment having a user-interfacing magnet positioned therein.
Figure 5A:
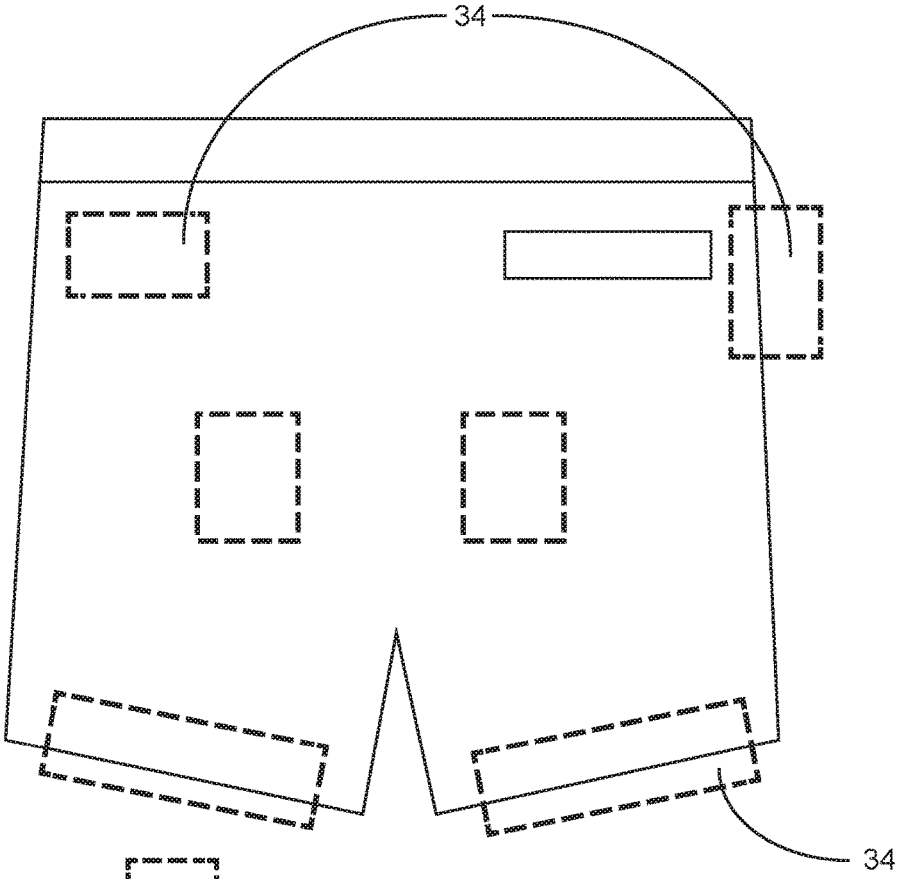
FIG. 5A shows a front plan view of a shorts-style user garment illustrating various magnet positions.
Figure 5B:
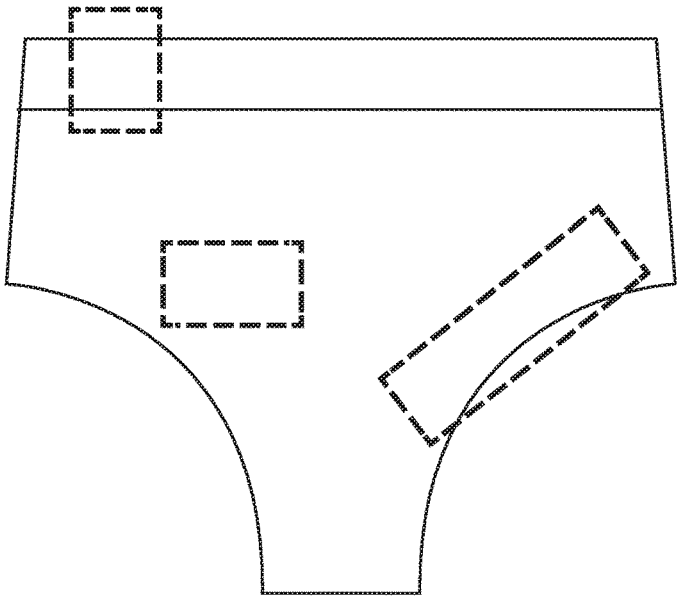
FIG. 5B shows a front plan view of a bikini-style user garment illustrating various magnet positions.

Regardless of which embodiment of the leash-interfacing magnet 32 is used, there is also a corresponding user-interfacing magnet 34 provided. The user-interfacing magnet 34 may be sewn into a user's waistband 50, as illustrated by FIG. 4. In this example, the magnet is inserted into the garment during the clothing manufacturing process. The user-interfacing magnet 34 generally has polarities opposite to the leash-interfacing magnet 32 and creates an attractive force/magnetic field 36. FIGS. 5A, 5B, and 5C illustrate alternate locations for the user-interfacing magnet 34. FIG. 5A illustrates that one or more user-interfacing magnet(s) 34 may be positioned below the waist band, along suit sides, along suit edges, and/or anywhere along the bathing suit body, or any combination thereof. FIG. 5B illustrates a woman's bathing suit and that one or more user-interfacing magnet(s) 34 may be positioned within or below the waist band, along sides, and/or anywhere along the bathing suit body, or any combination thereof. These figures illustrate embodiments in which one or more user-interfacing magnet(s) 34 are sewn into, adhered, welded, or otherwise associated with the user's bathing suit or clothing.

In another example, it is possible to provide a user-interfacing magnet kit. The kit may be provided with a small pouch or material piece that contains or otherwise supports the magnet 34. The pouch or material may be positioned, adhered, stitched, pinned, or otherwise secured to a bathing suit or other garment of choice of the user. In a specific example, the magnet may be heat sealed within a leather pouch portion. Edges of the leather pouch portion may have a plurality of edge holes. The edge holes may be used as guide holes for needle and thread for securing the magnet pouch to the garment. In order to ease the customer experience, the retrofit kit may be sold with the magnet pouch as well as with a needle and thread kit for easy securement of the pouch to the garment.

Figure 6B:
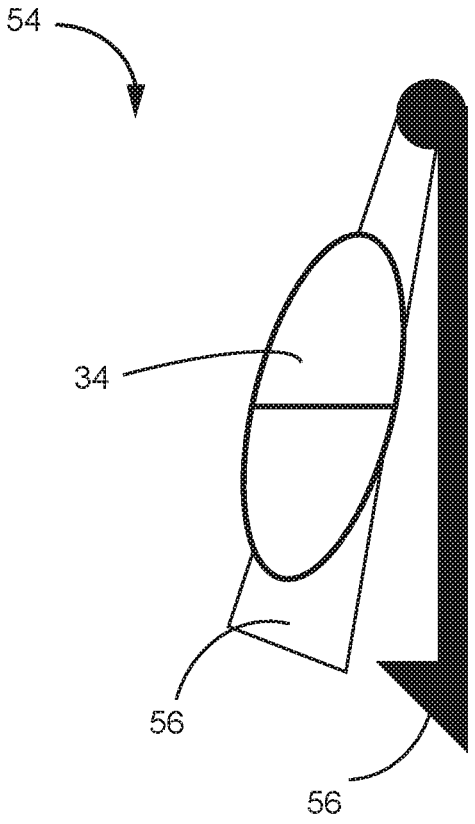
FIG. 6B illustrates a clip that could be used to support a user-interfacing magnet.
Figure 6A:
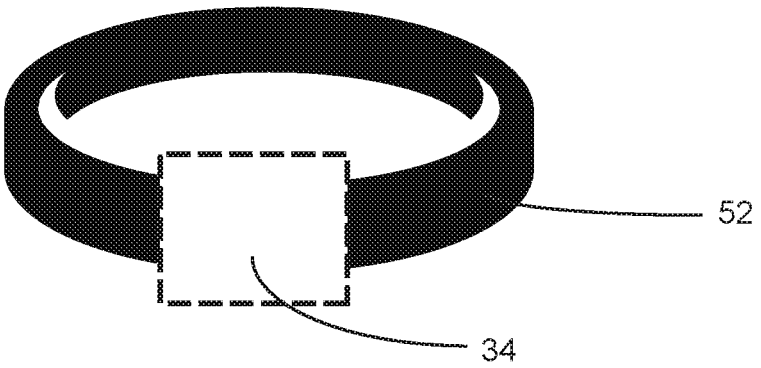
FIG. 6A illustrates a belt that could be used to support a user-interfacing magnet.

It is additionally possible to provide an embodiment in which one or more user-interfacing magnet(s) 34 may be worn by the user in a manner that is retrofittable. In other words, the user need not purchase a bathing suit that has the magnet 34 pre-positioned therein. In these examples, the magnet is configured to be provided as an aftermarket device. For example, instead, the user may wear a belt-like configuration 52 that has one or more user-interfacing magnet(s) 34 positioned therein. This example is illustrated by FIG. 6A. The positioning may be pre-sewn, adhered, attached or positioned in any other appropriate manner. In another example, the user may wear a clip 54 into which one or more user-interfacing magnet(s) 34 is/are positioned. This example is illustrated by FIG. 6B. In a specific example, the clip 54 may have two hinged arms 56, at least one of which supports magnet 34. The magnet 34 may be adhered to one of the arms 56. In another example, one of the arms 56 is made of a magnetic material itself.

Figure 6C:
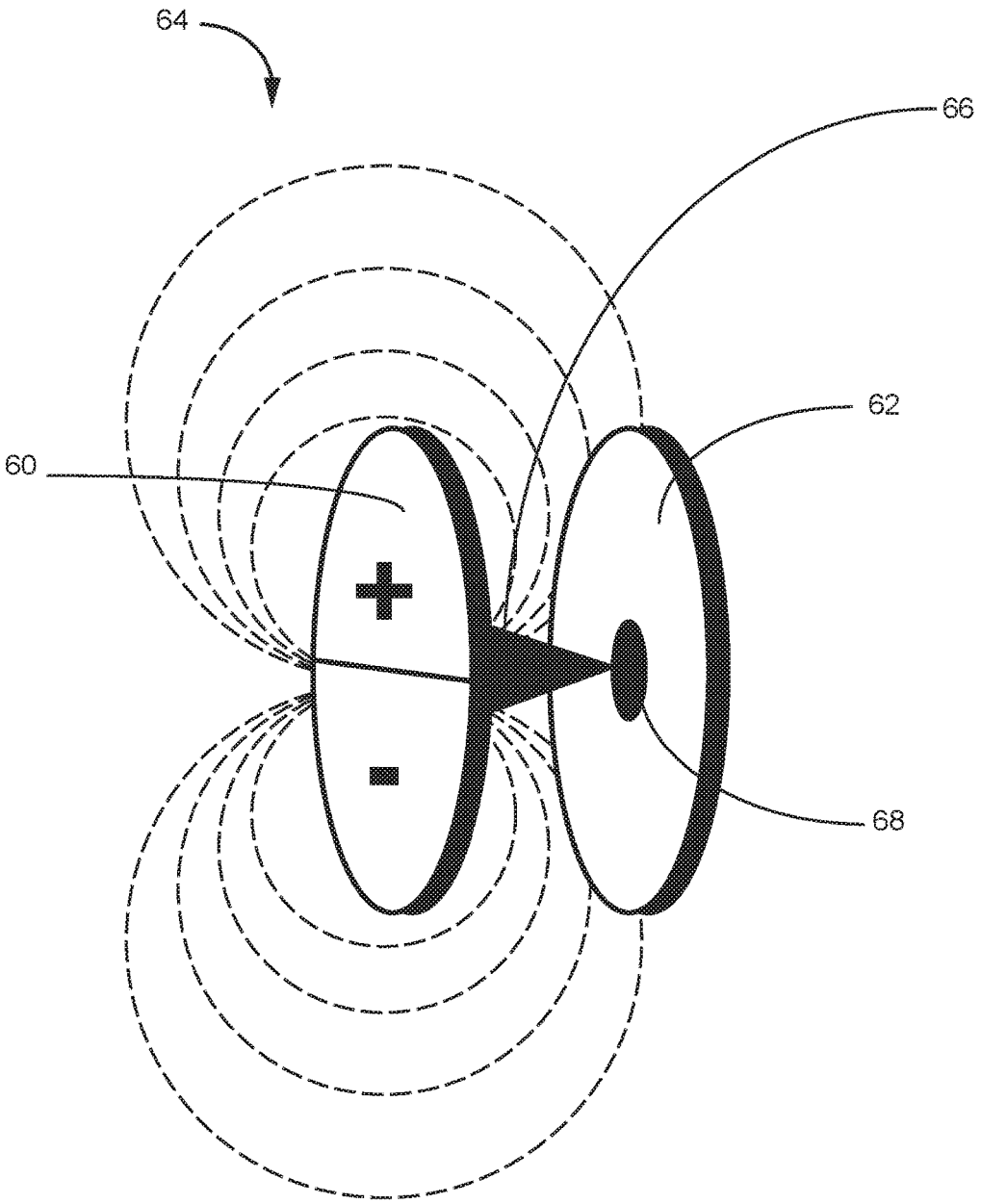
FIG. 6C illustrates a pin securement system that could be used to support a user-interfacing magnet.

Another option is to provide a pin securement system 64. In this example, a magnet face portion 60 and a rear portion 62 are joined by a pin securement system 64. This example is illustrated by FIG. 6C. This embodiment may function similar to store anti-theft tags, in which a pin 66 is received by an opening 68 of the rear portion 62. The system may be released via any appropriate method. In use, it is envisioned that the rear portion 62 be positioned on the wearer-side of the bathing suit and the magnet face portion 60 be positioned on the external-side of the bathing suit. This allows the user-interfacing magnet to be easily accessible to the leash-interfacing magnet. In any of these examples, the user can wear the belt 52, clip 54, or securement system, 64 without having specialty bathing suit or another bathing suit retrofitted. A single version or any combination of one or more of the disclosed versions are possible and considered within the scope of this disclosure.

The magnets used in accordance with this disclosure may be any appropriate magnets. Strong magnets have been increasingly made to be smaller and smaller, and it is generally envisioned that the smallest but strongest magnet combination for the size and strength required is desirable. Price considerations may be weighed with design considerations in order to optimize the combination provided.

Figure 7:
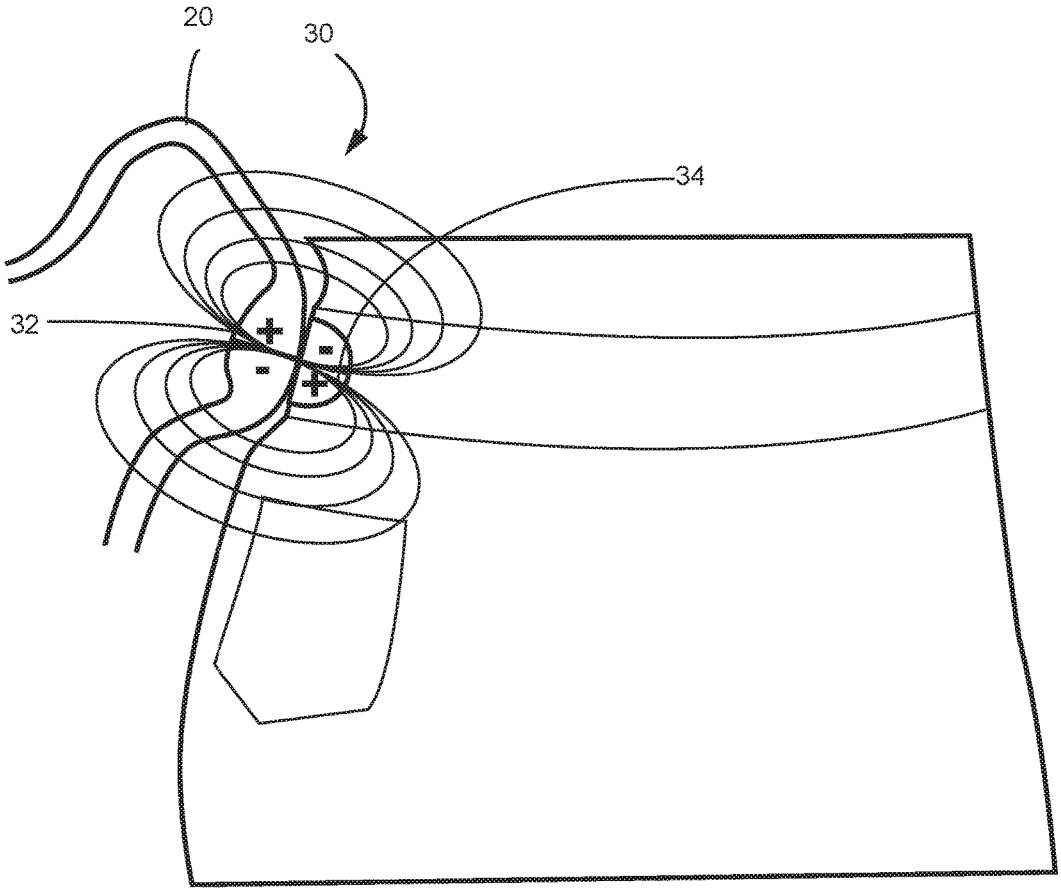
FIG. 7 illustrates cooperation between a leash-interfacing magnet and a user-interfacing magnet.

FIG. 7 illustrates a leash body 20 having its leash-interfacing magnet 32 in cooperation with the user-interfacing magnet 34. The magnets are generally envisioned as being strong enough that securement will be maintained while the user moves. However, the securement will be released upon a greater force, such as the user exiting the board in a forceful manner (e.g., a wipe out or ditch).

In use, as illustrated by FIG. 8, the user may wish to catch a wave with the leash lift system 30 already in position. This can ensure that the board-side portion 70 of the leash body 12 is raised, rather than dangling on the board surface when the user stands. FIG. 9 illustrates a user in the standing position. As illustrated, the board-side portion 70 of the leash body is prevented from being tangled around the user's ankle.

When the leash lift system 30 is used, the leash body is lifted out of the water and magnetically secured to the user using magnetic force. When a user is wearing a user-interfacing magnet 34 and is using a leash that has a leash-interfacing magnet 32, the following steps may take place:

(1) The user mounts the surf board or paddleboard onto which a leash with a leash-interfacing magnet 32 is positioned.

(2) The user lifts the leash and secures it to the implanted or attached user-interfacing magnet 34.

(3) When the magnetic field of the leash comes in contact with the magnetic field of the wearer, the leash will attach itself to the wearer. This method of attachment will elevate the length of the board-side portion of the leash from the water and the user's feet, which allows for reduced drag and reduced tripping hazards.

(4) when the user falls or is otherwise separated the necessary distance from the board, the pull force on the leash lift system will force the separation between the leash-interfacing magnet and the user-interfacing magnet. Once separated, the leash functions as originally designed, with the full length of the leash body accessible.

It is envisioned that one commercially viable design for this disclosure is an aftermarket system that provides a kit designed to allow a user to (a) retrofit the leash body and (b) retrofit a bathing suit with the desired magnetic features. An equally alternative commercially viable design for this disclosure is to provide a leash lift system that is sold with (a) a leash body having the leash-interfacing magnet integrally incorporated therein and (b) a bathing suit additionally having the user-interfacing magnet integrally incorporated therein. A further commercially viable design is to provide any combination of retrofit options (a) and (b) along with integral options (a) and (b). For example, a leash body having an integral leash-interfacing magnet may be sold with a bathing suit retrofit kit. In another example, a bathing suit having an integral user-interfacing magnet may be sold with a leash retrofit kit.

Although described primarily for use with water sports boards, it should be understood that this disclosure may also be used to manage other types of dangling cords. Non-limiting examples of cords or leashes that may be managed using the leash lift system described include but are not limited to extension cords, vacuum cords, animal leashes, or any other time a user may need to manage a trailing or potentially entangling cord or leash.

Changes and modifications, additions and deletions may be made to the structures and methods recited above and shown in the drawings without departing from the scope or spirit of the disclosure or the following claims.

What is claimed is:

1. A leash lift system, comprising:

a board leash comprising a first end for securement to a board and a second end for securement to a user's ankle or calf, the board leash further comprising a leash-interfacing magnet positioned along a leash body length between the first end and the second end; and a user garment comprising a user-interfacing magnet, wherein in use a user secures the leash-interfacing magnet to the user-interfacing magnet in order to elevate the leash body length from the board, and wherein, when a user falls or is separated a distance from the board, pull force on the leash lift system forces separation between the leash-interfacing magnet and the user-interfacing magnet, allowing the leash to function with the full leash body length available, wherein the leash-interfacing magnet comprises a clamshell configuration that supports that magnet.

2. The system of claim 1, wherein the leash interfacing magnet is attached onto the board leash-via an aftermarket device, such that a user may install the leash interfacing magnet on any leash of preference.

3. The system of claim 1, wherein the user-interfacing magnet is integrally formed into the user garment.

4. The system of claim 1, wherein the user-interfacing magnet is sewn into the waistband, sides, edges or body of the user garment.

5. The system of claim 1, wherein the user-interfacing magnet is attached onto the user garment via an aftermarket device, such that a user may install the user-interfacing magnet on any garment of preference.

6. The system of claim 1, wherein the user-interfacing magnet is provided on a belt.

7. The system of claim 1, wherein the user-interfacing magnet is provided on a clip.

8. The system of claim 1, wherein the user-interfacing magnet is provided on a pin securement system.

9. A method for securing a leash lift system, comprising:

(a) providing the system of claim 1;

(b) securing the leash-interfacing magnet to the user-interfacing magnet.

10. A leash lift system, comprising:

a board leash comprising a first end for securement to a board and a second end for securement to a user's ankle or calf, the board leash further comprising a leash-interfacing magnet positioned along a leash body length between the first end and the second end; and a user garment comprising a user-interfacing magnet, wherein in use a user secures the leash-interfacing magnet to the user-interfacing magnet in order to elevate the leash body length from the board, and wherein, when a user falls or is separated a distance from the board, pull force on the leash lift system forces separation between the leash-interfacing magnet and the user-interfacing magnet, allowing the leash to function with the full leash body length available, wherein the leash-interfacing magnet comprises a peel and stick adhesive that supports the magnet.

11. The system of claim 10, wherein the leash interfacing magnet is attached onto the board leash-via an aftermarket device, such that a user may install the leash interfacing magnet on any leash of preference.

12. The system of claim 10, wherein the user-interfacing magnet is integrally formed into the user garment.

13. The system of claim 10, wherein the user-interfacing magnet is sewn into the waistband, sides, edges or body of the user garment.

14. The system of claim 10, wherein the user-interfacing magnet is attached onto the user garment via an aftermarket device, such that a user may install the user-interfacing magnet on any garment of preference.

15. The system of claim 10, wherein the user-interfacing magnet is provided on a belt.

16. The system of claim 10, wherein the user-interfacing magnet is provided on a clip.

17. The system of claim 10, wherein the user-interfacing magnet is provided on a pin securement system.

18. A method for securing a leash lift system, comprising:

(a) providing the system of claim 10;

(b) securing the leash-interfacing magnet to the user-interfacing magnet.

* * * * *